United States Patent [19]

Dalbo

[11] Patent Number: 5,060,942

[45] Date of Patent: Oct. 29, 1991

[54] STROKE TRAINING DEVICE

[75] Inventor: Leo Dalbo, Sebatopal, Calif.

[73] Assignee: Dalme, Inc., Bloomfield Hills, Mich.

[21] Appl. No.: 609,158

[22] Filed: Nov. 2, 1990

[51] Int. Cl.[5] ..... A63B 69/00

[52] U.S. Cl. ..... 273/29 A; 273/26 R; 273/183 B

[58] Field of Search ..... 273/26 C, 29 A, 186 C, 273/186 A, 183 B, 188 R, 191 B, 193 A, 186 B

[56] References Cited

U.S. PATENT DOCUMENTS

| | | | |
|---|---|---|---|
| 1,962,256 | 6/1934 | Nelson et al. . | |
| 2,022,910 | 12/1935 | Hanley . | |
| 2,498,006 | 2/1950 | Ridill . | |
| 2,788,214 | 4/1957 | Tilden | 273/191 B |
| 2,893,736 | 7/1959 | Tesi | 273/188 R |
| 3,188,090 | 6/1965 | Job . | |
| 3,595,583 | 7/1971 | Oppenheimer | 273/191 B |
| 3,680,869 | 8/1972 | Brady . | |
| 3,804,420 | 4/1974 | Boyd . | |
| 3,858,881 | 1/1975 | Hurwitz . | |
| 3,937,465 | 2/1976 | Roland . | |
| 4,030,732 | 6/1977 | Vincent | 273/29 R |
| 4,134,589 | 1/1979 | Arena . | |
| 4,150,821 | 4/1979 | Racz . | |
| 4,209,169 | 6/1980 | Roberts . | |
| 4,445,686 | 5/1984 | Daugherty . | |
| 4,479,653 | 10/1984 | Woodson . | |
| 4,662,640 | 5/1987 | Gardner | 273/191 B |

FOREIGN PATENT DOCUMENTS

| | | | |
|---|---|---|---|
| 165960 | 7/1921 | United Kingdom | 273/188 R |

*Primary Examiner*—Theatrice Brown

*Attorney, Agent, or Firm*—Owen E. Perry; John C. Evans

[57] ABSTRACT

A stroke training device includes a guide member connected between the user's body and a stroking device which will focus the force of body rotation at a constant radius as the user's body moves between backstroke, stroking, and follow through positions; the guide member includes a reference surface located between the hand end of the stroking device and the user's body for defining a vertically extended reference plane located wholly between the hand end of the stroking device and the body within the constant radius of swing and moveable into a stroking or hitting plane including the object to be hit, which stroking and hitting plane is perpendicular to the line of contact with the object being hit for positioning the striking end of the stroking device within the stroking or hitting plane when the user's body is rotated into its stroking position.

1 Claim, 6 Drawing Sheets

FIG 1
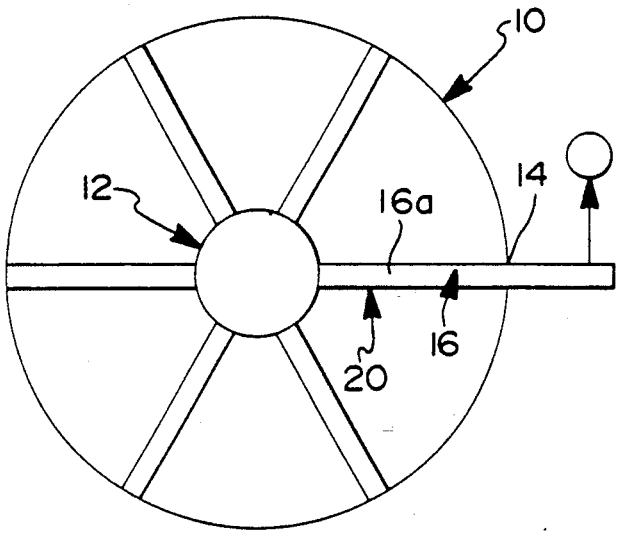
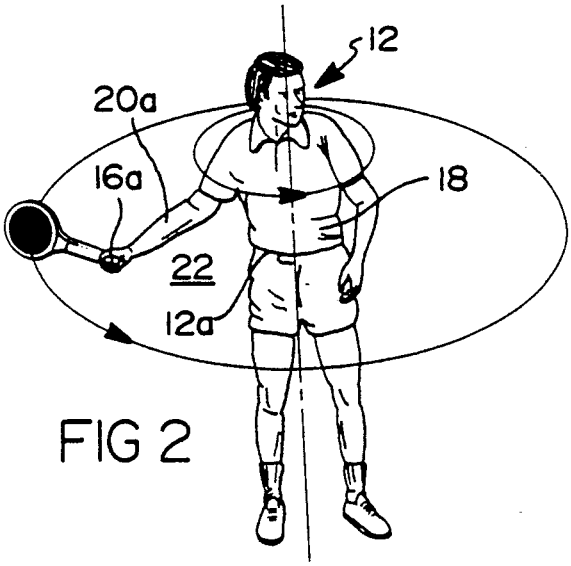
FIG 2
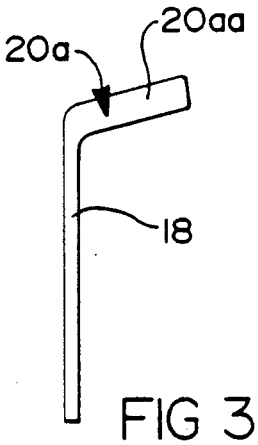
FIG 3
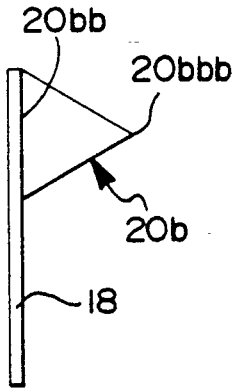
FIG 4
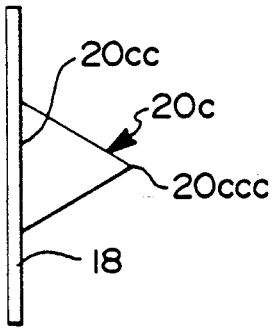
FIG 5
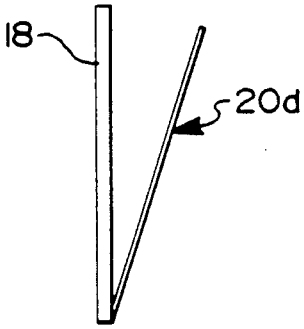
FIG 6

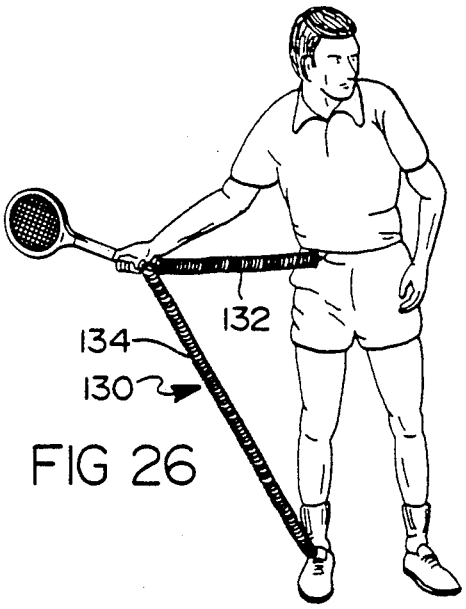
FIG 26
FIG 27
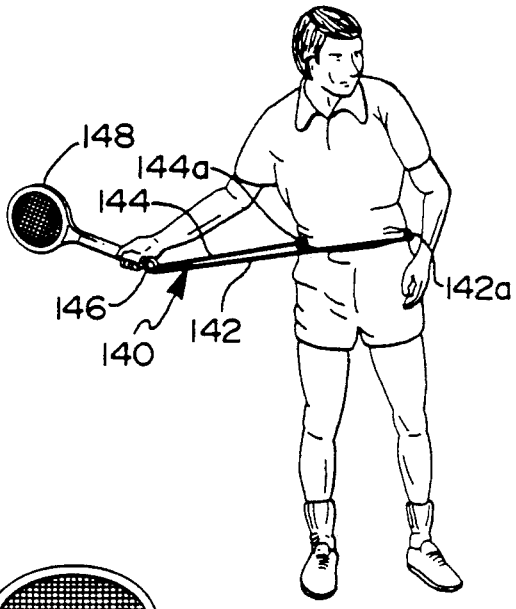
FIG 28
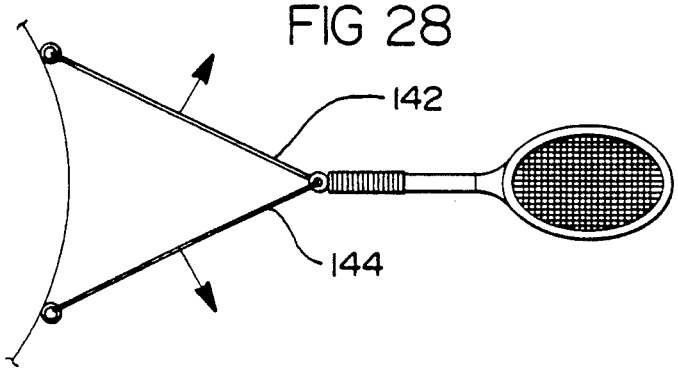
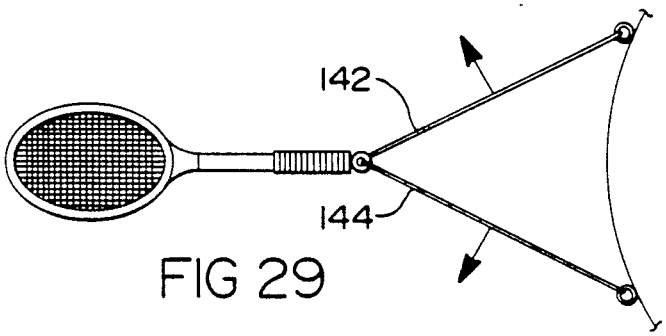
FIG 29

STROKE TRAINING DEVICE

FIELD OF THE INVENTION

This invention relates to stroke training devices and more particularly to stroke training devices carried by the user's body and arranged to provide repetitions of stroke movements required for accurate hitting of an object.

BACKGROUND OF THE INVENTION

Various stroke training devices for tennis are known which connect a user's wrist to the grip of a tennis racket. Examples of such devices are shown in U.S. Pat. Nos. 3,858,881; 4,150,821; 4,209,169; and 4,445,686. Such devices are used to teach a proper wrist position during stroking. One consequence of such training is to reduce tennis elbow. While suitable for their intended purpose, such stroke training devices do not provide training which will conform a tennis swing to the force generating capabilities of a properly rotating body swinging motion.

U.S. Pat. Nos. 3,937,465 and 4,030,732 disclose harness devices for controlling a tennis swing to prevent a tennis racket from shifting in a vertical plane below the wrist of a user. While the devices will train part of a tennis swing, they do not provide a device which will transmit and focus body rotation forces at the grip of a tennis racket so as to increase centrifugal forces at the head of the tennis racket.

Many other stroke training devices have been proposed for use in grooving a golf swing. U.S. Pat. Nos. 1,962,256; 2,022,910; 2,498,006; 3,188,090; and 3,804,420 are examples of such devices in which the golfers are restrained to prevent over swinging with the right hand in the case of a right handed golfer (the reverse with a left handed golfer). While suitable for their intended purpose, the devices do not train a golfer to focus the rotation energy of his body at the point which the club head will impact a ball during striking motion.

Another group of stroke training devices for golf include harness devices for preventing head lift during swinging (U.S. Pat. No. 4,134,589); a tension device that will signal the user so that the user will feel departures from a proper swing pattern (U.S. Pat. No. 4,662,640); devices which will produce an audible signal when the golf swing is improper (U.S. Pat. No. 3,680,869); an elbow swing control device to prevent casting of the elbow during the backswing (U.S. Pat. No. 3,804,420); and a device which will hold the club grip and apply a force on the user's hands so as to train against the user rearing up either immediately prior to striking of the ball or immediately following striking of the ball (U.S. Pat. No. 4,479,653). None of the aforesaid stroke training devices are configured or arranged to train a golfer to properly focus the force of body rotation at the user's hands for extension to the point of striking the ball.

One problem with prior art stroking devices is that they do not provide for proper application of the forces of body rotation at the point of object impact.

SUMMARY OF THE INVENTION

Accordingly, an object of the present invention is to provide a simplified device connected between the hand grip of a stroking device and the body of the user for application force produced during body rotation so as to focus the force at the user's hand at a fixed repeatable distance from the user's body, and to provide a reference surface observable by the user at a point located wholly between the hand end of the stroking device and the body within a substantially constant radius swing and moveable into a plane including the object to be hit and which plane is perpendicular to the line of contact with the object being hit for positioning the striking end of the stroking device within the perpendicular plane when the user's body is rotated into its striking position.

A feature of the present invention is to provide a stroke training device for a sport in which a stroking device having a hand held end and a object striking end is rotated about the longitudinal axis of a body by rotation of the user's body between a backstroke position of the user's body, a stroke position of the user's body and a follow through position of the user's body for striking an object, wherein a guide member is provided for focusing force generated by rotation of the body about its longitudinal axis to the hand end of the stroking device at a first constant radius from the longitudinal axis of the user's body at the backstroke position, the stroking position and the follow through position of the stroking device; the guide member including a radially inwardly located portion thereon joined to said body along a predetermined vertical extent of the body and a reference surface is located between the hand end of the stroking device and the radially inwardly located portion for defining a vertically extended reference plane located wholly between the hand end of the stroking device and the body and moveable into a plane perpendicular to the line of contact with the object being struck for positioning the striking end of the stroking device within the perpendicular plane when the user's body is rotated into a stroking position.

Another feature of the present invention is to provide such a stroke training device wherein the force application member is a triangular guide member for focusing energy from rotation of the body about its longitudinal axis to the hand end of the stroking device at a first constant radius from the longitudinal axis of the user's body at the backstroke position, the stroking position and the follow through position of the stroking device and is useful in training a user to effectively use such body rotation force in either a golf swing or a tennis swing.

A further feature is to provide a stroke training device with such a triangular guide member including a radially inwardly located portion thereon joined to the body along a predetermined vertical extent of the body; and wherein the triangular guide member includes a reference surface located between the hand end of the stroking device and the radially inwardly located portion for defining a vertically extended reference plane located wholly between the hand end of the stroking device and the body and moveable into a plane perpendicular to the line of contact with the object being struck for positioning the striking end of the stroking device within the perpendicular plane when the user's body is rotated into a stroking position.

A still further feature is to provide the stroke training device of the preceding paragraphs wherein the force application member is a rigid member and a pivot member; the rigid member having opposite ends one of which is connected to the hand end of the stroking device and the other of which is connected to the pivot member; the pivot member being connected to said body for allowing for swinging movement of the hand end about a constant radius as the body is moved between the backstroke position and the follow through position.

Yet another feature of the present invention is to provide the stroke training device with a force application member that is a flexible member having an extended length equal to a constant swing radius and including opposite ends thereon; one of the opposite ends connected to the hand end of said stroking device and the other of the opposite ends connected to the body either above the waist or below the waist.

Still another feature of the present invention is to provide the stroke training device with a force application member in the form of a ring; and providing a connector for connecting a first segment of the ring to the hand end of the stroking device and another connector for connecting a second segment of the ring located diametrically opposite said first segment to the body of a user.

These and other objects, features and advantages will be more apparent in few of the following description when taken in conjunction with the attached drawings wherein:

BRIEF DESCRIPTION OF THE DRAWINGS

FIG. 1 is a diagrammatic view of a force application pattern applicable to the present invention;

FIG. 2 shows a rotation axis diagram for use with the present invention;

FIGS. 3–6 are diagrammatic views of force application devices applicable to the present invention and their points of connection to the body rotation axis of FIG. 2;

FIGS. 25 and 26 are diagrammatic views of other embodiments of a tennis stroke training device; and FIG.S 27–29 are diagrammatic views, side and top, of another embodiment of a tennis stroke training device.

DETAILED DESCRIPTION OF PREFERRED EMBODIMENTS OF THE INVENTION

Figure 7:
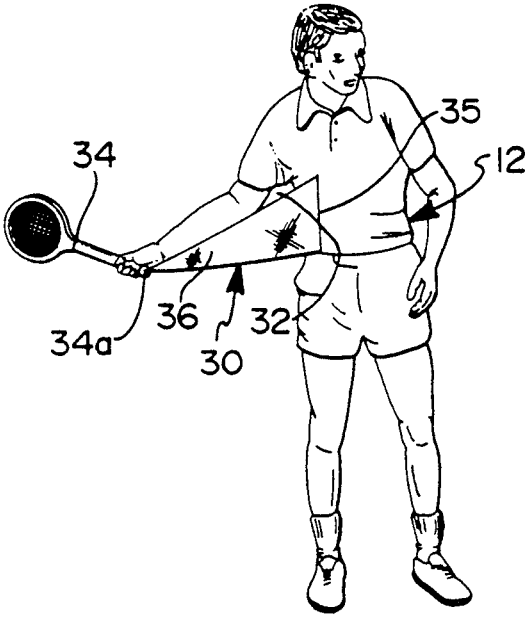
FIGS. 7–9 are diagrammatic views, respectively, of the backswing, stroking, follow through positions of one embodiment of the invention.
Figure 8:
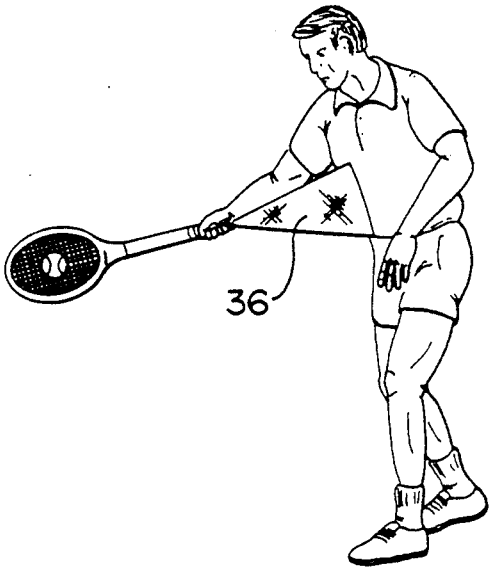
Figure 9:
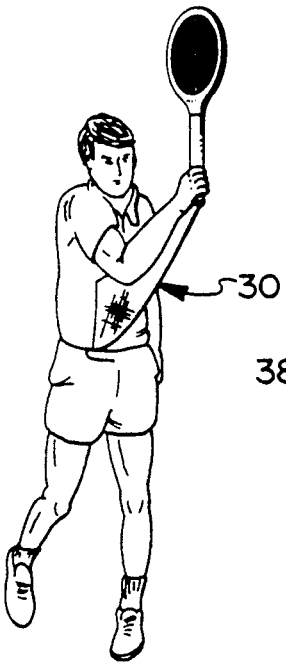

Referring now to FIG. 1 a force diagram 10 is illustrated in which a representation of the axis of rotation of a body or torso of a person is designated by reference numeral 12. In the diagram the position of the body 12 can be analogized as representing the hub of a wheel. The force diagram also includes a representation of the striking surface of a stroking device such as a tennis racket head or the club face of a golf club, designated by reference numeral 14. The position and movement of the striking surface 14 can be analogized to a segment on the rim of a wheel which will have a greater velocity than the body 12 as the body 12 is rotated about its axis of rotation during either a tennis swing or a golf swing. The diagram of FIG. 1 further includes a representation of a stroking device 16 that extends radially from the body 12 much as the spoke of a wheel. The stroking device 16 has a grip portion **16*a* located radially inwardly of the movement of the striking surface 14. The grip portion 16*a* represents a hand position of the user at a point closely adjacent the body 12 to maintain swing control. The striking surface 14 will have a greater velocity than the velocity of the user's hand located at the position designated by the reference numeral 16*a***.

In accordance with one aspect of the present invention, the hand location at reference numeral **16*a* is maintained close to the vertical axis 18 through the user's body 12 shown in FIG. 2**.

In another aspect of the invention, the body 12 and arm **12*a* shown in FIG. 2 combine to produce a force on the grip portion 16*a* dependent upon the combined mass of the rotating body 12 and arm 20*a*. The force produced by combined body rotation and arm rotation increases the force vector at the grip portion 16*a*** since the body mass is substantially greater than of the mass of arm swing alone.

The present invention is intended to provide a training device which will repetitively guide the body, hands and hand grip of a stroking device such as a tennis racket or a golf club in a manner which will teach the user to apply the increased force of body rotation at the striking position of the stroking device against an object being hit thereby to increase the velocity of the hit object.

More particularly as shown in FIGS. 4–6, the invention contemplates use of a guide member 20 that will fill a space or region 22 between the user's body 12 and the hand grip **16*a* of the stroking device. The guide member 20 maintains the space 22 at a substantially constant radius throughout the swing motion. The result is to place the greater force of body mass rotation in a location which will link the swing of the stroking device to such body rotation at the hand grip location. The stroking device 16 is a radial extension of the guide member 20. The radial extension of the stroking device results in the aforedescribed greater velocity at the striking surface. In addition to the greater striking velocity a greater force is imposed on the object being hit because the force application member 20 is constructed and arranged to add the mass of the rotating body in the swinging movement as will be discussed in detail below In FIG. 3, the guide member 20 is in the form of a rigid radial arm 20*a* having one end connected to the body 12 and an opposite free end 20*aa* adapted to be connected to the hand grip of a striking device. The rigid radial arm 20*a* is thus arranged to located the hand grip closely inboard of the body 12 and to rotate the body 12 and hand grip as a unitary mass. The rigid radial arm 20***a* is specifically applicable to tennis or other racquet sports.

In FIG. 4, the guide member 20 is in the form of a flexible generally triangular guide member 20*b* having a base segment 20*bb* connected to the body 12 above the waist line 12*a*. The insert member 20*b* has an apex end 20*bbb* adapted to be connected to the hand grip of a striking device. The flexible insert member 20*b* thereby is arranged to located the hand grip closely inboard of the body 12 and it serves as a reference when fully extended to cause the hand grip and body 12 to rotate as a unitary mass to produce the force and velocity results discussed above. The guide device 20*b* is specifically applicable to golf or tennis depending upon where the base segment 20*bb* is connected to the body 12. Specific forms of this version of the invention will be discussed in more detail in the following description of the invention.

In FIG. 5 the force application member 20 is a triangular guide member 20*c* having a base segment 20*cc* connected to the body 12 below the waist line 12*a*. The insert member 20*c* has a free apex end 20*ccc* adapted to be connected to the hand grip of a striking device. The flexible guide member 20*c* thereby is arranged to locate the hand grip closely inboard toward the body 12 and the insert member 20*c* is located to serve as a reference surface when fully extended to cause the hand grip and body 12 to rotate as a unitary mass to produce the force and velocity results described with reference to the force diagrams of FIGS. 1 and 2. The guide member 20*c* is a specific adaptation of the invention to tennis as will be discussed.

In FIG. 6 the guide member 20 is a rigid arm 20*d* connected between a lower extremity of the body 12 and the hand grip. When the hand grip is maintained at a normal hitting position the rigid arm 20*d* will fill the space to hold the hand grip closely to the body 12 and the filled space will serve as a reference to coordinate the rotation of the body 12 with normal arm swinging movement to produce the force and velocity results discussed above. The rigid arm 20*d* and its location is an application specific to tennis.

In each of the aforesaid embodiments of the invention the force enhancement of a wheel type rotating machine is incorporated. The point of attachment of the force application member to the body will vary with the application but the exact point of attachment is not as important as the fact that the force application member 20 is attached to move as a unit with the body 12 so as to focus the user on the body 12 as the primary source of hitting power.

In the case of the human body, the machine axis of rotation is the spine and the torso and arms moving as a unit. The striking device, either the racquet or the club, is merely an extension of the body wherein the arms and hands are merely connecting agents, e.g., they do very little work other than to hold the racket in close proximity to the body 12. As discussed above, when the power is supplied to the body machine by rotating the torso around the spine axis the body rotation will cause force power to be transmitted to the racquet or the club. In the case of an average person body weight is in the order of 125 lbs. for a female and 150 lbs. for a male. These figures represent a mass weight which is between 12–15 times greater than the mass represented when only the arms and hands are used in moving the stroking device to strike an object for propelling the object from a stroke position.

Figure 10:
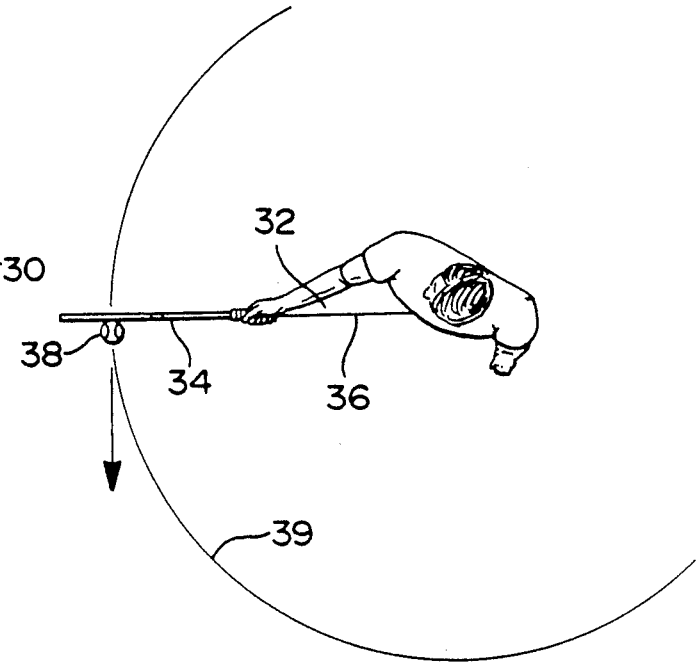
FIG. 10 is a top view of the embodiment of FIGS. 7–9 at the stroking position.

Referring now to FIGS. 7–10 an embodiment of the invention is shown including a guide member 30 that fills a control space 32 formed between a body 12 and a hand grip of a tennis racquet 34. The guide member 30 can be formed of a flexible material such as canvas, woven cloth or flexible plastic. The member 30 has a generally triangular shape to fill a space 32. The member 30 has a base portion 35 with a vertical height that extends upwardly from the waist. The base portion 35 is connected to the body 12 from the waist to a point in the vicinity of the elbow along a vertical line slightly on the right side of the torso as shown in FIG. 7. The line of connection can vary to suit a particular body configuration with it being understood that the body attachment of the base portion 35 is the important consideration since it is this connection that focuses the force of body rotation at the hand grip 34*a* of the tennis racquet. The guide member 30 will hold the hand grip 34*a* in a position close to the torso as it rotates to provide a controlled feel to the swinging movement. The swinging movement for a forehand hit is shown starting at the backswing in FIG. 7, proceeding to the point of impact shown in FIG. 8 and ending with the follow-through shown in FIG. 9. In each case the force application member 30 has a guide surface 36 thereon located in a position clearly visible to the user. The guide surface 36 is arranged close to the torso of body 12 and when it is aligned perpendicular to the direction of the hit line, as shown in FIG. 10, the racquet head will be automatically positioned in a proper hitting orientation with a ball 38 which will be struck to move in a line generally perpendicular from the head of the racquet. The guide member 30 will only assume the desired perpendicularity to the hitting line and will only align the racquet in a plane perpendicular to such line when the user's body is properly rotated from the backhand position of FIG. 7 to the hitting or strike position of FIG. 8. In such case the hitting force and velocity will be maximized as discussed heretofore. The arc of body rotation is designated by reference numeral 39 in FIG. 10. As long as the member 30 remains taut and is joined to the body to rotate with the body, it will assume the position shown in FIG. 10. The user can train the stroke by repeating the swing until the feel of combined body and hand movement are firmly established. The user senses that the guide surface 36 will hit the ball when the body is properly oriented. The passive extension represented by the racquet head will do the hitting but with the enhanced force and velocity due to proper body rotation.

Figure 11:
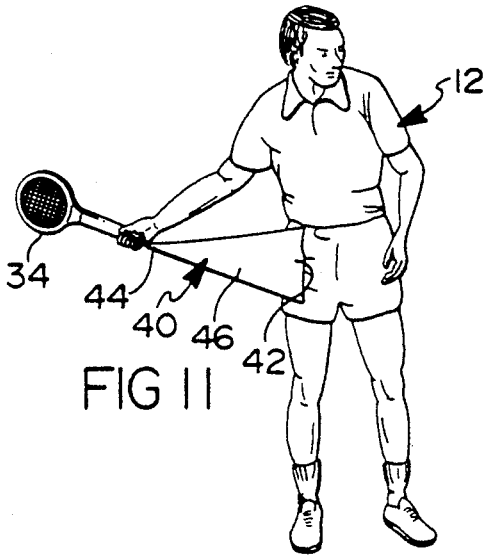
FIGS. 11–15 are, respectively, diagrammatic views of five other embodiments of tennis stroke training devices of the present invention.

In the embodiment of FIG. 11, the stroke training device includes a guide member 40 illustrated as having a triangular shape. It is made of flexible material like in the embodiment of FIGS. 7–10 and is connected between the body 12 and racquet 34 by a base portion 42 and an apex end 44. In this embodiment, however, the member 40 has the base connected below the waist line along the right leg in the case of a right handed tennis player. This configuration will cause the user to feel that the right leg and the body are the axis of the swing.

The member 40 has a guide surface 46 which is visible to the user of the stroke training device and locate close to the body to that proper body rotation will locate the guide surface 46 between the hand end of the stroking device which in this embodiment is the racquet 34 and the right leg in the thigh region for defining a vertically extended reference plane located wholly between the hand end of the stroking device and the body and moveable into a plane perpendicular to the line of contact with the object being struck for positioning the head end of the racquet within the perpendicular plane when the user's body is rotated into a hitting or stroking position.

Figure 12:
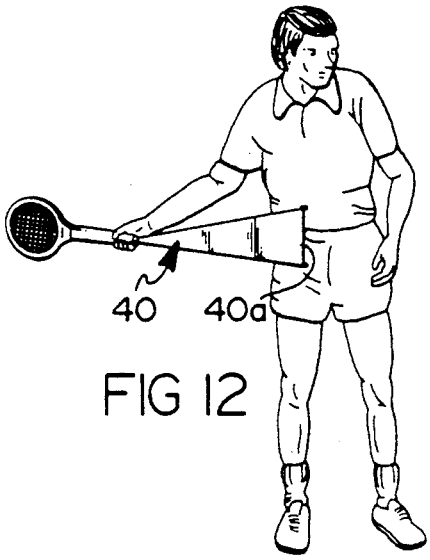

The embodiment of FIG. 12 is like the FIG. 11 embodiment except that the base portion 40*a* of the member 40 is connected equidistantly on either side of the waist along a vertical line located on the torso toward the right side thereof.

Figure 13:
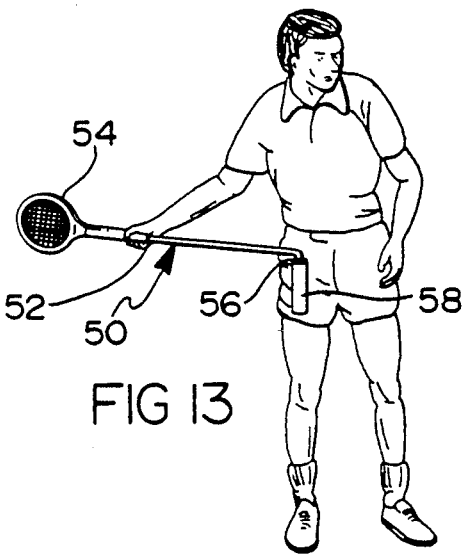
Figure 14:
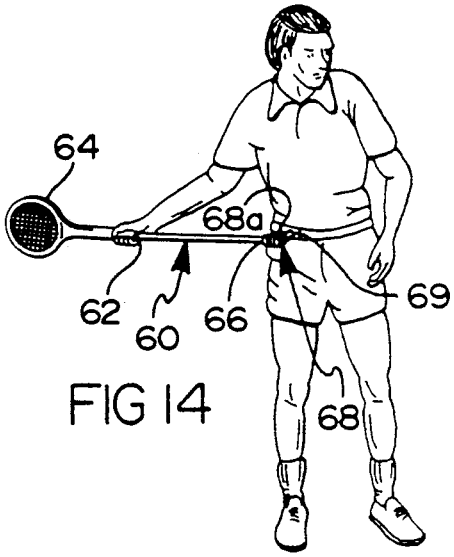

The embodiments of FIGS. 13–14 have a rigid member that locates the handgrip closely proximate to the body. The rigid member fills an open space between the handgrip and the body and will rotate as a unit with the body. When such joint rotation occurs, the rigid member acts like a wheel spoke having a higher force imposed thereon by the moving mass of the body. The stroking device merely serves as a passive extension from the rigid member which is placed in its striking position when the rigid member is arranged perpendicular to the line of flight of the struck object.

More specifically, in FIG. 13 a rigid member 50 is shown having a radially outer end 52 connected to the handgrip of a tennis racquet 54. The rigid member 50 has a radially inboard bent end 56 which fits in a guide tube 58 connected to the right leg of the user below the waist. The rigid member 50 will hold the handgrip position at a fixed or substantially fixed radius during the swing movement and it serves as a radially extended reference line located wholly between the hand end of the stroking device and the body and moveable into a plane perpendicular to the line of contact with the object being struck for positioning the striking end or head of the racquet stroking device within the perpendicular plane when the user's body is rotated into a hitting or stroking. In this arrangement, the rigid member 50 is visible to the user and serves as a guide which the user feels is hitting the object when the body is properly rotated when in fact the passive extension represented by the tennis racquet 54 will do the hitting. The radially inboard position of the rigid member makes the swing easier to control and repeat. Upon a number of repetitions the user is able to be trained to feel the proper unitary motion of body and hand grip that will result in the improved hitting force on the ball.

The embodiment of FIG. 14 is like FIG. 13 but it shows a rigid member 60 having a radially outboard end 62 connected to the handgrip of a tennis racquet 64. The rigid member 60 has a radially inwardly located end 66 connected to a bellows tube 68 that will bend to allow for swinging movement of the guide member 60 to follow rotation of the body 12. The bellows tube 68 is made of flexible plastic having convolutions 68*a* formed therein. The base of the tube 68 is fixedly secured to a plate member 69 secured to the waist of the user slightly on his right hand side. The rigid member 60 is visible to the user and thereby serves as a guide which the user feels is hitting the object when the body is properly rotated when in fact the passive extension represented by the tennis racquet 64 will do the hitting. The radially inboard position of the rigid member makes the swing easier to control and repeat. Upon a number of repetitions the user is able to be trained to feel the proper unitary motion of body and hand grip that will result in the improved hitting force due to proper body rotation.

Figure 15:
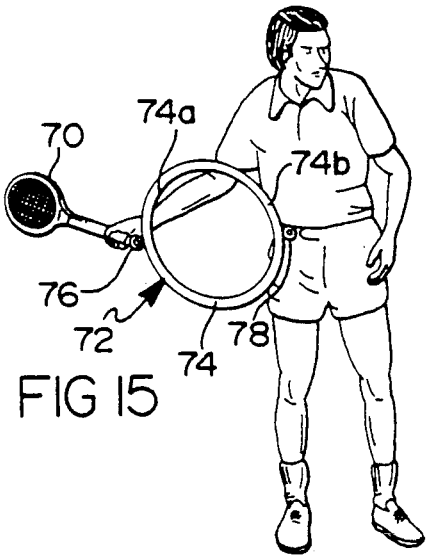
Figure 15A:
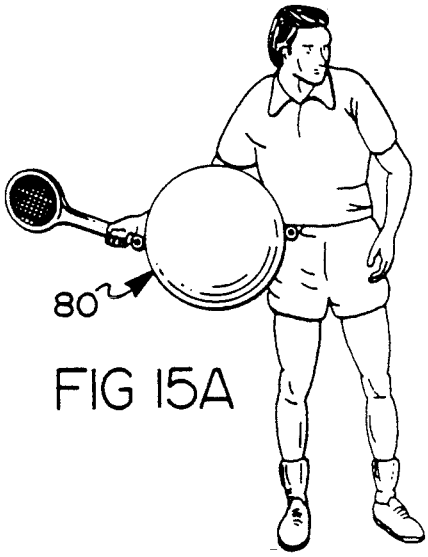
FIG. 15A is a diagrammatic view of a ball embodiment of a tennis stroke training device.

The embodiment of the invention shown in FIG. 15 includes a guide member 72 in the form of a ring 74. A pivot connector 76 is connected between the handgrip of a racquet 70 and a first side segment 74*a* of the ring 74. Another pivot connector 78 is provided for connecting a second segment 74*b* of the ring 74 to the user's waist. The segment 74*b* is located diametrically opposite the first segment 74*a*. In this embodiment the racquet is attached to the end of the ring so that upon rotation of the body during swinging of the racquet, the user feels as if the tennis ball is being hit with the center of the ring. This feeling forces the user to turn the body to use the big powerful muscles of the torso to create a more forceful swing with little effort. If desired the ring 74 can be replaced by a large diameter ball 80 as shown in FIG. 15A. The swinging movement is the same and the ball fills the space between a proper handgrip position and the body and is connected in the same manner as ring 72 such that the user feels that the large ball will strike the tennis ball when the body is properly rotated during the swing.

The embodiment of the invention shown in FIGS. 16–20 shows a stroke training device 90 for training a golf swing. In this embodiment the device 90 includes a flexible generally triangular guide device member 92 having a base portion 94 adapted to connect to the torso of the user on the left side of the torso and extending vertically on the torso from a point slightly above the waist of the user to a point on the chest slightly below the user's elbow. The positions can be modified to fit particular body types with it being understood that the important fact is that the member 92 will fill a space between the body and the handgrip position and will extend to form a reference or guide surface which will enable the user to train the swing to include body rotation and hand grip rotation as a unit. To this end, member 92 has two elongated sides 92*a*, 92*b* joined at an apex 96. The apex 96 is joined to the handgrip 98 of a golf club 100. As in the previous embodiments, the force application member 92 will focus the body rotation forces at the handgrip to improve hitting power when the body and arms are rotated together to move a reference surface 92*c* on the force application member 92 to ensure the unitary movement of body and handgrip during the swinging movement. The guide surface or reference surface 92*c* is visible to the user of the stroke training device and it is located close to the body so that proper body rotation will locate the guide surface 92*c* between the hand end of the stroking device which in this embodiment is the golf club 100 for defining a vertically extended reference plane located wholly between the hand end of the stroking device and the body at the address and ball hitting position shown in FIGS. 17 and 19. During proper body rotation from the backstroke position shown in FIG. 16, the force application member 92 is moveable into a plane perpendicular to the line of contact with the golf ball thereby positioning the striking end or club face of the golf club within the perpendicular plane when the user's body is rotated into a hitting or stroking position. The arc of body and guide member rotation is shown at 102 in FIG. 20. As in the earlier embodiments the greater mass of the body is joined to the handgrip of the club 100 by the guide member 92 to fill the normally empty space therebetween. The user is trained by repetitiously rotating the reference or guide surface 92*c* with the body to the position shown in FIGS. 17 and 19. The user feels that the guide surface 92*c* is striking the ball. The shaft 100*a* of club 100 is a passive extension of the rotating body and guide member and its club face 100*b* will be the point of contact during the swing. However, the use of the stroke training device 90 will enable the user to train the large force applying muscles of the body to feel the swing which will produce the greatest force and velocity at contact of the clubhead face 100*b* with the golf ball.

Figure 16:
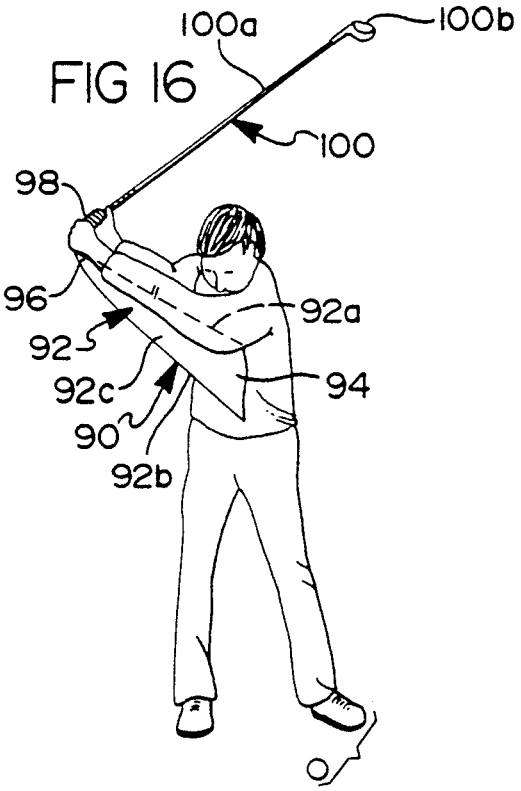
FIGS. 16–19 are diagrammatic views, respectively, of the backswing, stroking, and follow through position of another embodiment of the invention for golf stroke training.
Figure 17:
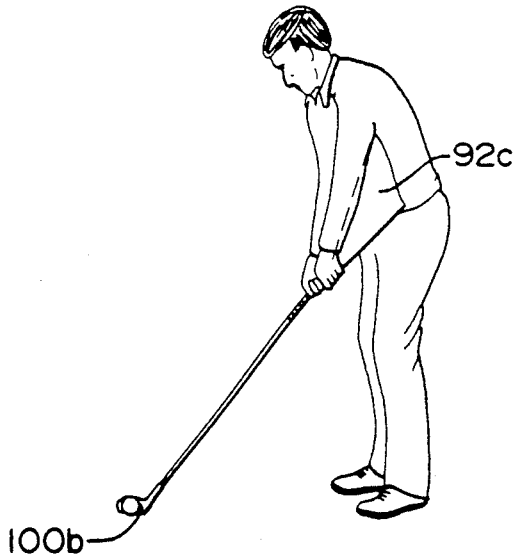
Figure 18:
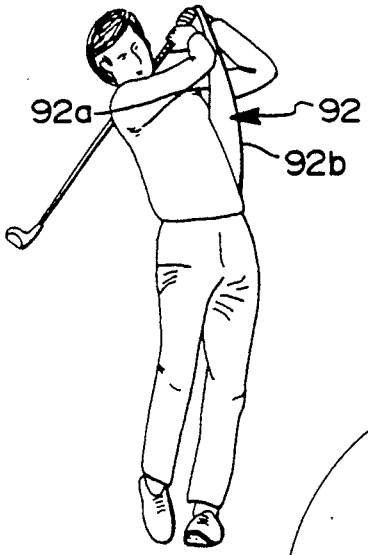
Figure 19:
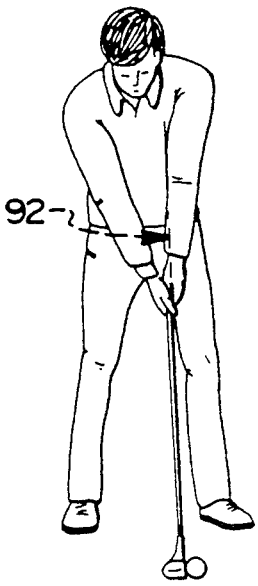
Figure 20:
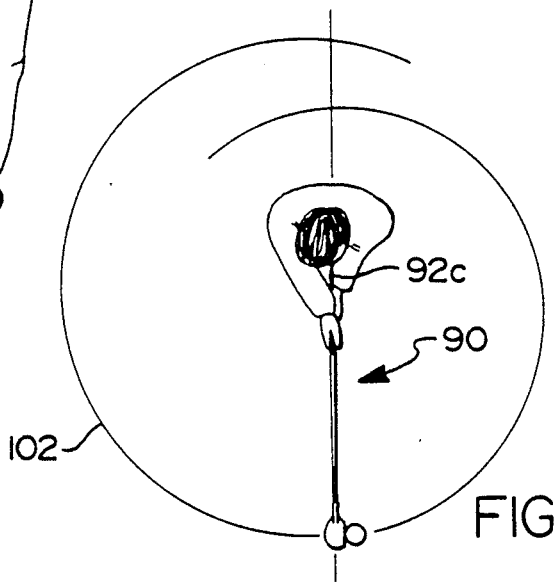
FIG. 20 is a top view of the embodiment of FIGS. 15–19 at the stroking position.

The backstroke position of the device 90 is shown in FIG. 16. The guide member 92 is extended and flexes to allow a full backswing of the golf club. In order to return the guide surface 92 into the hitting position it is necessary to rotate the body and guide surface 92 as a unit. This is easily accomplished by the user keeping his eyes on the surface 92 and feeling that it is being positioned to hit the golf ball. Such movement will in fact return the passive extension represented by the club shaft 100*a* to the stroke or hit position shown in FIGS. 17 and 19. The follow through position is shown in FIG. 18 with the body being fully rotated in order that the guide member 92 will be free to flex upwardly for club follow through.

Figure 21:
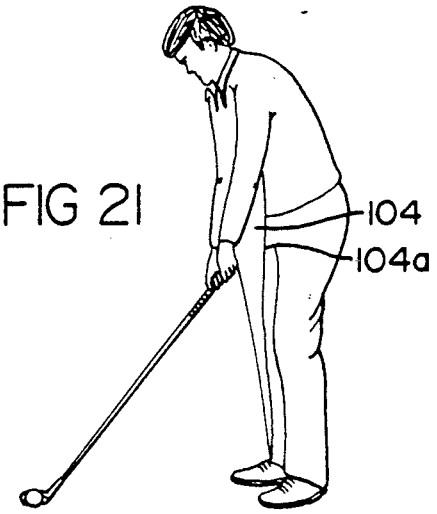
FIG. 21 is a diagrammatic view of another embodiment of the invention for golf stroke training.
Figure 22:
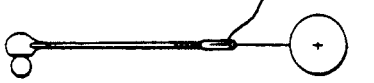
FIGS. 22 and 23 are diagrammatic views of the body rotation force diagrams for use with the embodiments of FIGS. 15–19 and FIG. 20.

In the embodiment of the invention shown in FIG. 21, a guide member 104 is shown having a generally triangular shape and including an elongated base portion 104*a* attached along the right leg from the ankle to a point adjacent the elbow on the right side of the chest. This embodiment will enable the user to feel that the right leg and body are the axis of the swing so as to train the large body muscles to both shift weight from the left to the right side and back while partially rotating the body as discussed above. The end of the club will rest on the device and separate on follow-through so as to provide an unrestricted swinging movement.

Figure 23:
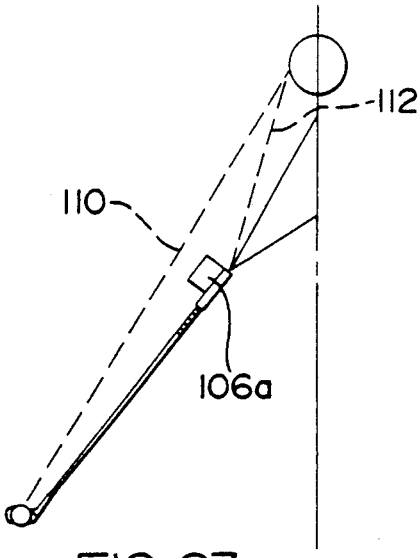
Figure 24:
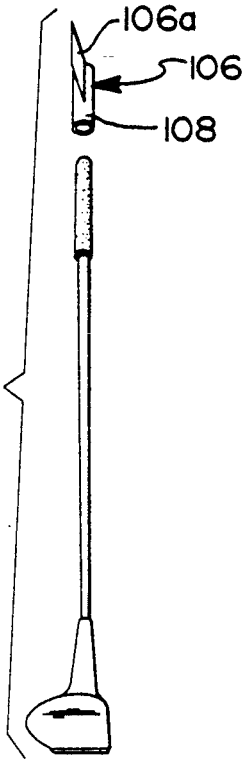
FIG. 24 is a perspective view of another golf swing training device including the reference plane feature of the present invention.
Figure 24A:
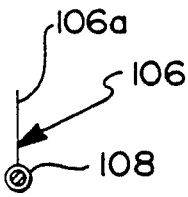
FIG. 24A is an end elevational view of the FIG. 24 device.
Figure 24B:
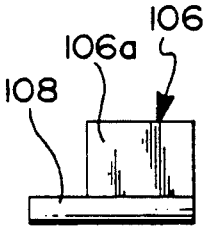
FIG. 24B is a side elevational view of the FIG. 24 device.

In the embodiment of the invention shown in FIG. 24, a space filler plate 106 is shown which includes a tube 108 that fits over the club grip. The filler plate 106 is shown in perspective in FIG. 24; is shown in end elevation in FIG. 24*a* and is shown in side elevation in FIG. 24*b*. In this embodiment the user must maintain the proper club head swing radius during swinging but the filler plate 106 will be observable to indicate generally if the club is following the proper path as long as the plate 106 is located close to the body. The filler plate 106 will properly orient the club in its hitting plane when a reference surface 106*a* thereon is located within a vertical plane which includes the golf ball and which vertical plane is arranged perpendicular to the path of travel of the struck ball. As in the earlier embodiments the user feels as if the reference surface 106*a* is hitting the ball when the body is properly rotated. In fact the passive extension or spoke represented by the club and the club head will be positioned by the same movement to locate the club head in a perpendicular hitting or stroke position against the ball. The training action enables the user to focus on an object close into his body without having to worry about precisely positioning the clubhead in space throughout the swing to return it to the address and hitting position as shown by the line of sight designated 110 in FIG. 23. The line of sight merely has to move along the line 112 to observe the proper positioning of the filler plate 106 which represents the guide member equivalent in this embodiment. Repetitions of the training action will train the large hitting muscles of the body to feel proper body rotation to enhance hitting force and velocity.

Figure 25:
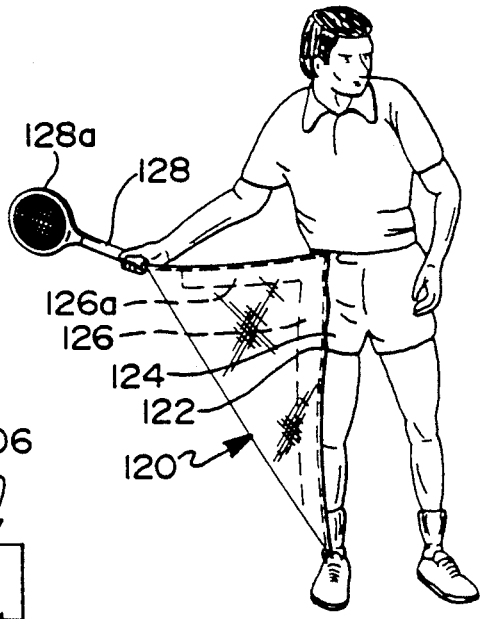

Still other embodiments of the invention are shown in FIGS. 25 and 26 wherein force application member is arranged between the ankle an leg of a tennis player for connection to the handgrip of a tennis racket. In FIG. 25, the force application member is in the form of a triangular member 120 of flexible material such as plastic or the like. The triangular guide member 120 has a base portion 122 connected to the right leg and body from the ankle to the waist of leg 124. This arrangement creates a feeling that the right leg and body are the axis of the swing and the result is like arranging a hockey stick outline 126 on the member 120. As the body rotates, the user feels as if the face 126*a* of the hockey stick is hitting the ball when in fact the passive extension represented by the tennis racquet 128 will be automatically positioned to produce contact between head 128*a* and the tennis ball. The handle end of the racquet 128 can rest on the top of member 120 and separate on follow-through without restriction.

The embodiment in FIG. 26 forms a triangular filler 130 which serves the same purpose as triangular guide member 120. In this embodiment, the guide member 130 includes two flexible coils 132 and 134. The upper coil 132 represents the segment of the triangular filler 130 which establishes a generally constant radius in the swing. The lower coil 134 connects between the ankle and the handle grip of a racquet to tie the leg to the body and thereby produce a feeling like the hockey stick hit described in the embodiment of FIG. 25. The coils 132 and 134 are plastic coils of the kind used on phone cord to provide for slight adjustments of the swinging plane but retaining the feel of a unitary mass which will hit the ball on proper rotation of the body. The user will feel that the upper coil 132 is hitting the ball while the actual hit is by the head of the racquet.

Still another embodiment of the invention is shown in FIGS. 27–29. In this embodiment a stroke training device 140 is shown including a pair of coiled cables 142, 144 located in a horizontal plane passing through the waist of a user. The cable 142 has a radially inwardly located end 142*a* connected to the waist band and the cable 144 has its radially inwardly located end 144*a* connected to the waist band on the other side thereof. The cables 142 and 144 have radially outwardly located ends connected at a pivot connector 146 that fits over the hand grip of a racquet 148. As shown in FIG. 28, The cable 142 will act as a guide for forehand hit and the cable 144 will act as a guide for backhand hits. In FIG. 29 the cables are shown oriented for a left hand player with the respective cables 142, and 144 being arranged for guiding backhand and forehand strokes respectively.

It should be understood that each of the devices shown above for use with a right handed person are equally adaptable for use with left handed persons. In the case of left hand applications the points of attachment will vary from those shown above and the word left will be substituted for right in the aforedescribed right handed embodiments.

It will be further understood that other changes may be made to the illustrated embodiments without departing from the principles of the invention as set forth in the claims herein.

What is claimed is:

1. A stroke training device for training a user of a stroking device such as a tennis racquet or golf club having a hand held end and an object striking end, said stroke training device being connected between the stroking device and the body of the user to act as a constraint on the path of movement of said stroking device as the user swings the stroking device between backstroke, stroking and follow through positions of the user's body; said stroke training device being characterized by a flexible triangular guide member having an apex portion defining a stroking device end and a base portion defining a body engaging end; said stroking device end being connected to the hand held end of the stroking device and said base portion including upper and lower ends connected at vertically spaced points to a user's torso such that said triangular member lies in a vertical plane parallel to the axis of rotation of the user's body in its unobstructed condition; said guide member being operable to provide a reference surface between the hand held end of the stroking device and the user's body, which reference surface being observable wholly between said hand held end and the body of the user and to coordinate movement of the user's body with the stroking device.

* * * * *